US007510431B2

(12) United States Patent
Zhu et al.

(10) Patent No.: US 7,510,431 B2
(45) Date of Patent: Mar. 31, 2009

(54) ELECTRICAL CONNECTOR WITH IMPROVED BOARD LOCKS

(75) Inventors: Zi-Qiang Zhu, Kunshan (CN); Xing-Hai Xiang, Kunshan (CN); Kai Chen, Kunshan (CN); Xiao-Hui Yin, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/974,572

(22) Filed: Oct. 15, 2007

(65) Prior Publication Data

US 2008/0090455 A1 Apr. 17, 2008

(30) Foreign Application Priority Data

Oct. 16, 2006 (CN) ..... 2006 2 0126459

(51) Int. Cl.
*H01R 13/60* (2006.01)

(52) U.S. Cl. ..... 439/567; 439/607; 439/572; 439/358

(58) Field of Classification Search ..... 439/567, 439/352, 607–609, 571–572, 358
See application file for complete search history.

(56) References Cited

U.S. PATENT DOCUMENTS

| | | | | |
|---|---|---|---|---|
| 5,807,135 | A * | 9/1998 | Clark | 439/567 |
| 6,012,954 | A | 1/2000 | Wu | |
| 6,379,181 | B1 * | 4/2002 | Chang et al. | 439/567 |
| 6,386,910 | B1 * | 5/2002 | Yu | 439/567 |

* cited by examiner

*Primary Examiner*—Truc T Nguyen
(74) *Attorney, Agent, or Firm*—Wei Te Chung

(57) ABSTRACT

An electrical connector (100) includes an insulative housing (10), a number of contacts (20) retained in the insulative housing, a metal shell (30) shielding the insulative housing, and a pair of board locks (40). The insulative housing has a body portion (11) and a mating portion (12). The body portion defines a pair of receiving spaces (14) extending therethrough. Each board lock has a first plate (41) with a hollow cylinder (44) and a hook section (42) extending out of the insulative housing. The metal shell defines a pair of through holes (33) corresponding to the hollow cylinders respectively. The metal shell and the insulative housing sandwich the first plates of the board locks therebetween.

20 Claims, 5 Drawing Sheets

ELECTRICAL CONNECTOR WITH IMPROVED BOARD LOCKS

BACKGROUND OF THE INVENTION

1. Field of the Invention

The present invention relates to an electrical connector, and more particularly to an electrical connector with improved board locks.

2. Description of Related Art

U.S. Pat. No. 6,012,954 discloses a conventional electrical connector which comprises an insulative housing, a plurality of terminals received in the insulative housing, a shell partially enclosing the housing, a pair of board locks and a pair of fasteners for assembling the board locks onto the housing. Each fastener has a first plate and a hollow cylinder extending from the first plate. The hollow cylinder extends through a through hole of the board lock with the first plate to abut against the board lock on a rear side of the insulative housing. The hollow cylinder further extends through the housing and the shell to abutting against a front surface. Therefore, the housing, the shell, and the board lock are secured together by the fastener. Since the connector needs a fastener to be assembled as a whole and to establish a grounding path between the shell and the board lock, the number of the elements of the connector is increased and complicated the structure of the connector. As a result, the cost of the connector is also increased.

Hence, an improved electrical connector is needed to solve the problem above.

BRIEF SUMMARY OF THE INVENTION

Accordingly, a main object of the present invention is to provide an electrical connector with improved board lock for easy assembly and reducing cost.

In order to obtain the object, an electrical connector comprises an insulative housing, a plurality of contacts retained in the insulative housing, a metal shell shielding the insulative housing, and a pair of board locks. The insulative housing has a body portion and a mating portion. The body portion defines a pair of receiving spaces extending therethrough. Each board locks comprises a first plate with a hollow cylinder, a hook section extending out of the insulative housing, and a connect section connect the first plate with the hook section. The metal shell defines a pair of through holes corresponding to the hollow cylinders respectively. The metal shell and the insulative housing sandwich the first plates of the board locks therebetween.

The body portion and mating portion of the insulative housing can be separated. The electrical connector further comprises a full-proofing device for insuring the body portion and mating portion mating with each other accurately. The full-proofing device is arranged only on one side of the electrical connector and includes a post and a slit fitting with each other. The post and the slit being arranged on the body portion and the mating portion respectively.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
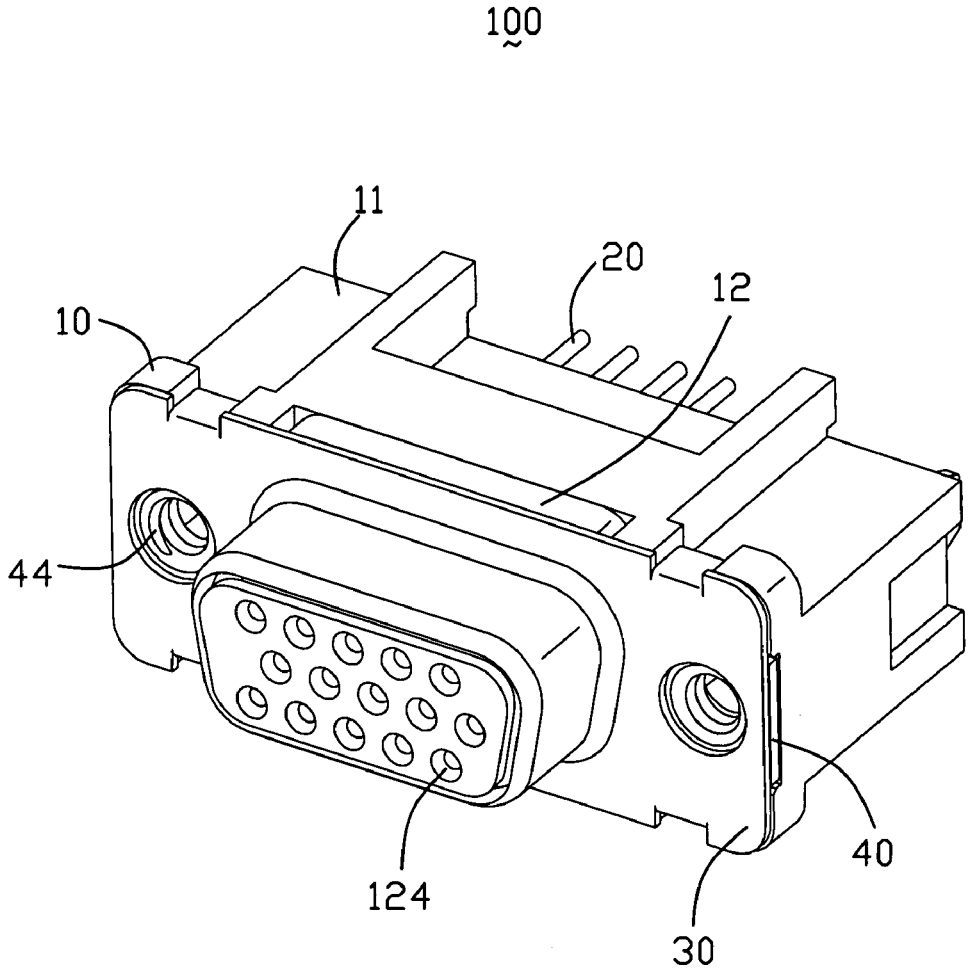
FIG. 1 is a perspective view of an electrical connector according to the present invention.
Figure 2:
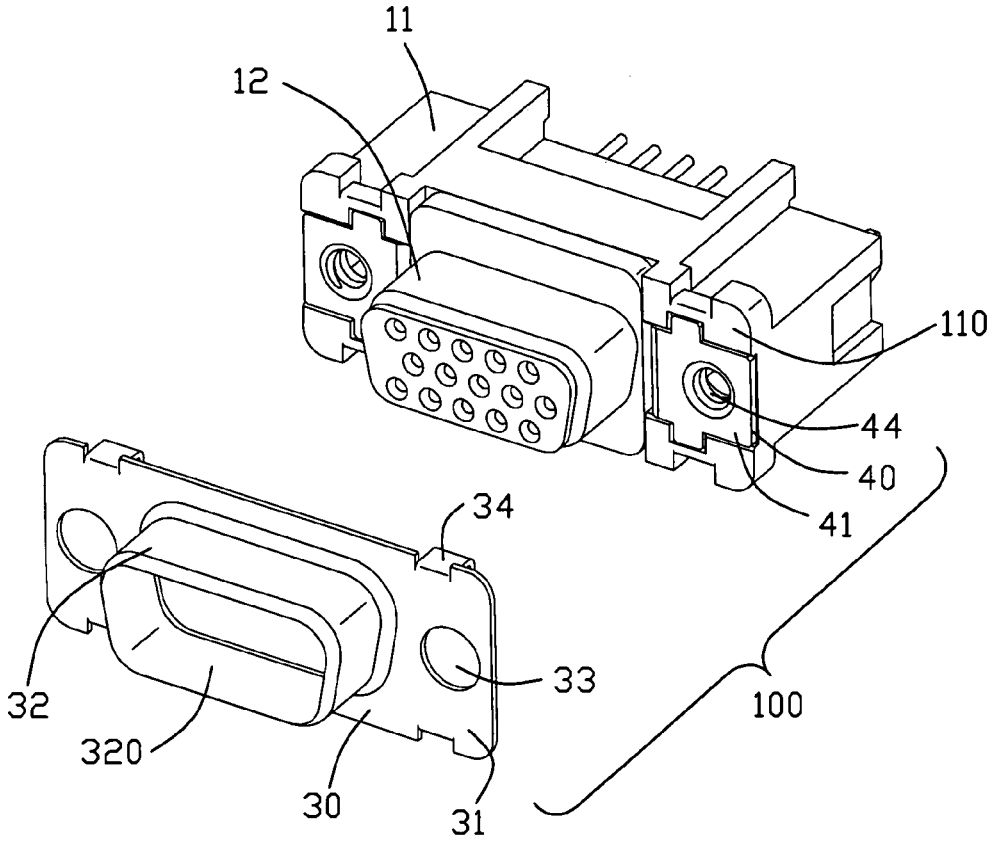
FIG. 2 is a perspective view of the electrical connector shown in FIG. 1, showing the metal shell detaching from the housing.

Reference will be made to the drawing figures to describe the present invention in detail, wherein depicted elements are not necessarily shown to scaf Referring to FIGS. 1-3, an electrical connector 100 includes an insulative housing 10, a plurality of contacts 20 retained in the insulative housing 10, a metal shell 30 partially enclosing the insulative housing 10, and a pair of integrated board locks 40.

Figure 3:
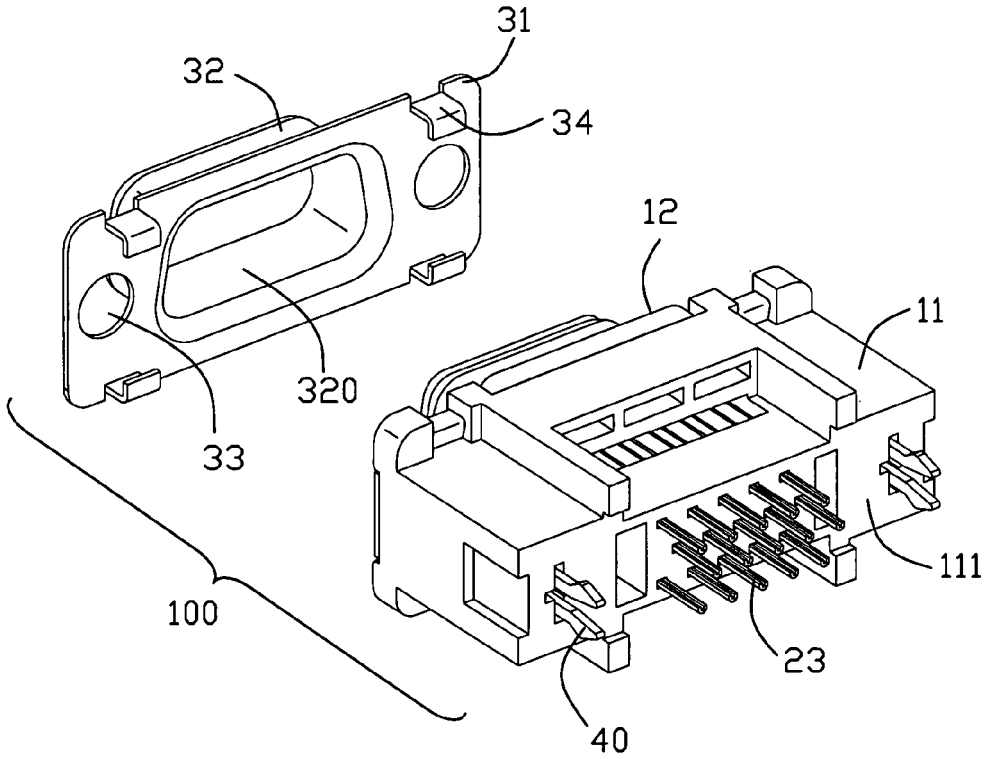
FIG. 3 is similar to FIG. 2, but viewed from another aspect.
Figure 4:
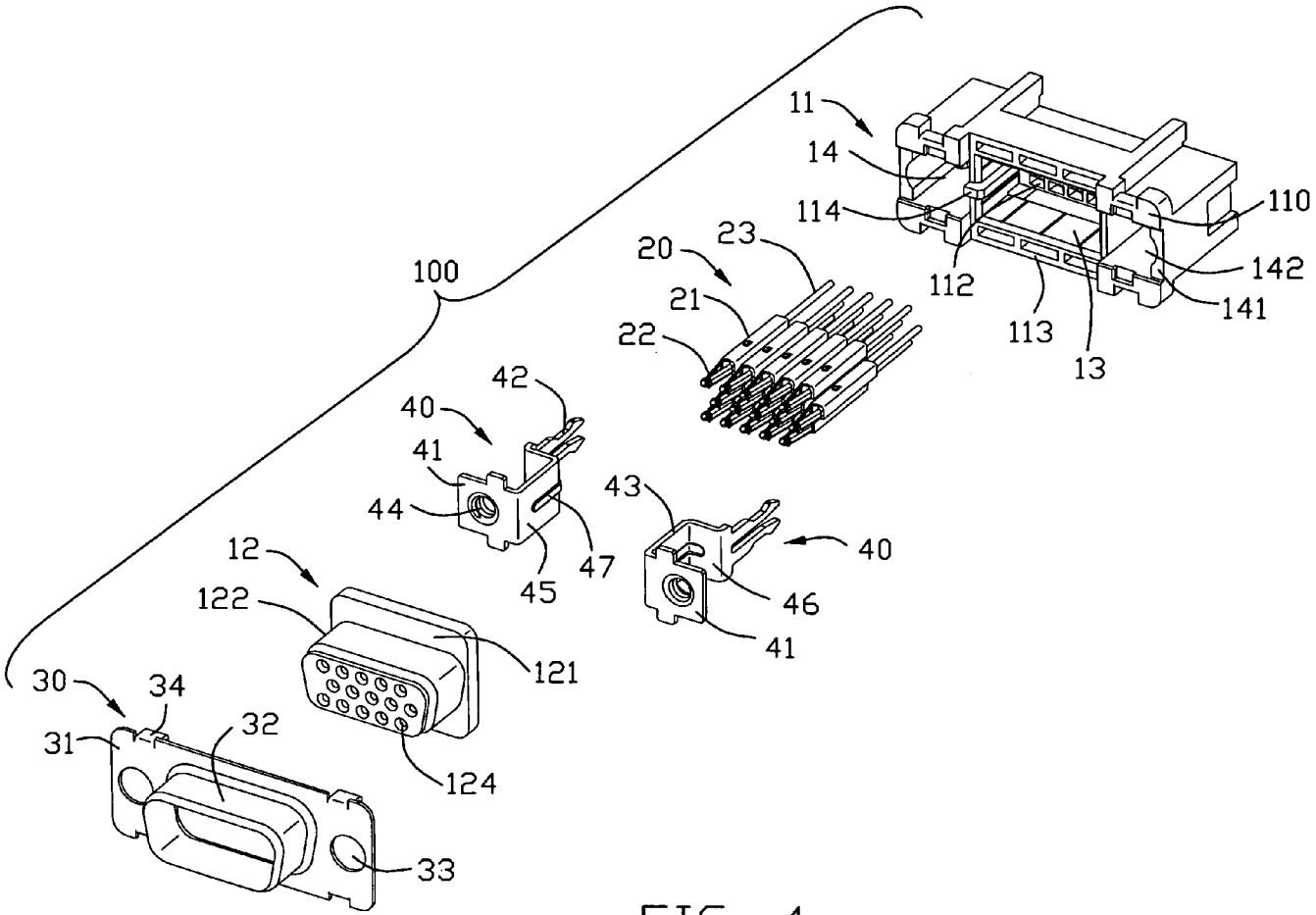
FIG. 4 is an exploded view of the electrical connector shown in FIG. 1.
Figure 5:
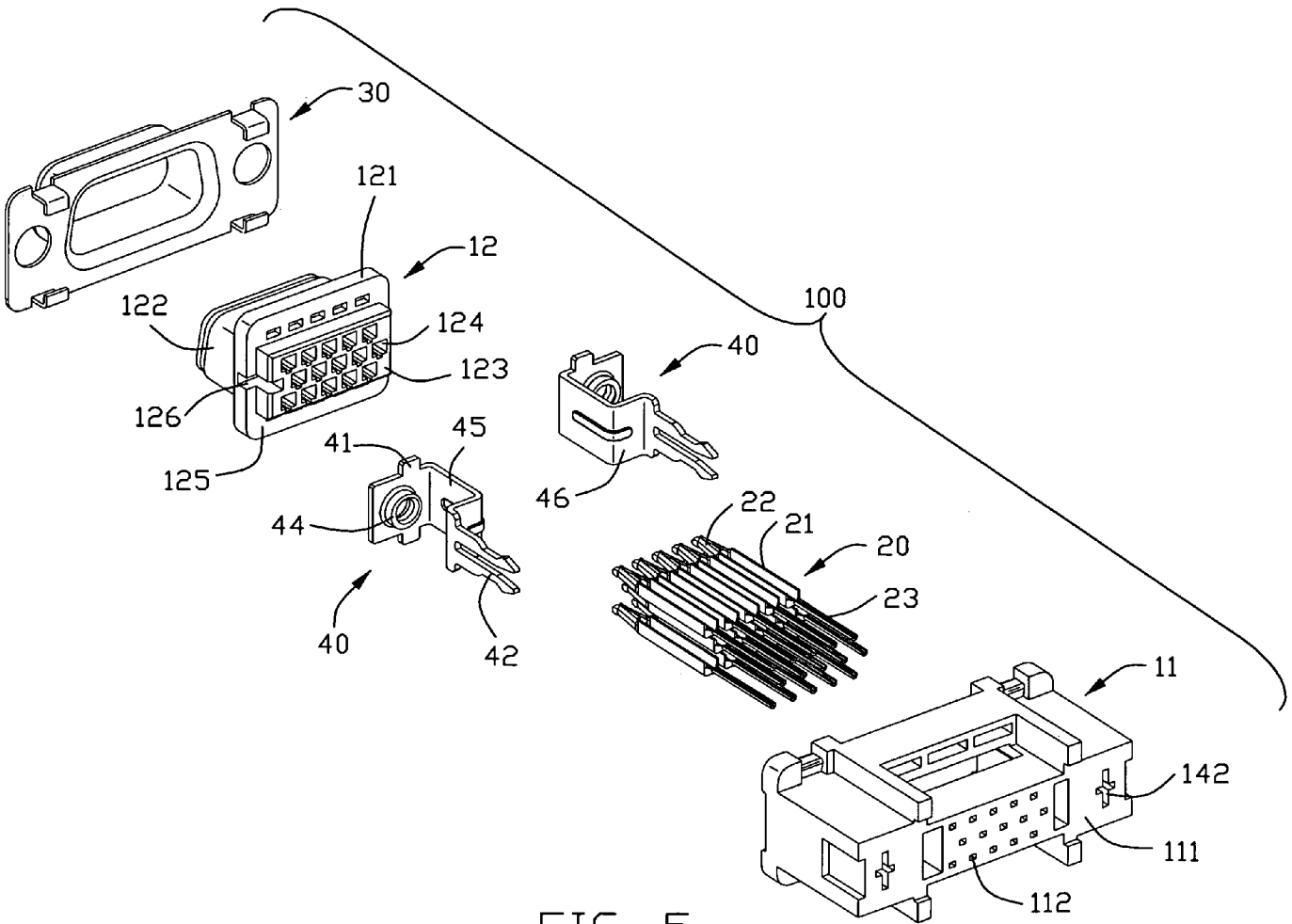
FIG. 5 is similar to FIG. 4, but viewed from another aspect.

Referring to FIGS. 3-5, the insulative housing 10 having a body portion 11 and a mating portion 12 apart from the body portion 11. The body portion 10 has a front face 110 for contacting with the shell 30 and a rear face 111 opposite to the front face 110 for mounting a mother board (not shown). The body portion 11 defines a central space 13 opening to the front face 110 for receiving the mating portion 12 therein. The body portion 11 further defines a pair of receiving spaces 14 extending therethrough at lateral sides thereof. Each receiving spaces 14 comprises a first recess 141 and a second recess 142. The body portion 11 defines a plurality of through holes 112 behind the central space 13.

The mating portion 12 includes a base plate 121, a front section 122 extending forwardly from the base plate 121, and a rear section 123 opposite to the front section 122. The mating portion 12 defines a plurality of passageways 124 extending therethrough and corresponding to the through holes 112.

The body portion 11 and the mating portion 12 each defines a mating face 113, 125 contacting with each other. The insulative housing 10 further comprises a full-proofing device thereonon. The full-proofing device includes a post 114 and a slit 126 mating with each other. The post 114 is projecting from the mating face 113 to the front face 110 of the body portion 11. The slit 126 is defines on the mating face 125 of the mating portion 12. The post 114 and the slit 126 are only arranged on one side of the insulative housing 10 thereby the body portion 11 and the mating portion 12 can accurately mate with each other and avoid the electrical contacts 20 inserting into the insulative housing 10 by error.

Each electrical contacts 20 comprises a retention section 21 engaging with the passageways 124 of the mating portion 12, a contact section 22 extending forwardly from the retention section 21, and a mounting section 23 connecting with the retention section 21. The mounting section 23 is received in the through holes 112 and projects out of the rear face 111 of the body portion 11.

The board locks 40 are received in the receiving spaces 14 of the body portion 11 and each comprises a first plate 41, a hook section 42 extending out of the insulative housing 10, and a connect section 43 connecting the first plate 41 with the hook section 42. The first plate 41 includes a hollow cylinder 44. The connect section 43 comprises a second plate 45 extending vertically from a side edge of the first plate 41 and a third plate 46 parallel to the first plate 41. The hook section 42 is connected with the third plate 41 and perpendicular thereto. The second and third plate 45, 46 each include a rib 47 thereon for abutting to the body portion 11. The first plate 41 is received in the first recess 141 and the connect section 43 and the hollow cylinder 44 are received in the second recess 142.

The metal shell 3 comprises a flat portion 31 to be attached to the front surface 110 of the body portion 11 and a D-shaped projection 32 protruding forwardly from the mating portion 31. The mating portion 31 defines a pair of through holes 33 on lateral sides thereof and corresponding to the hollow cylinder 44 of the board lock 40. The projection 32 is hollow to define a chamber 320 therein for the front section 123 of the mating portion 12 extending therein. The metal shell 30 also comprises a plurality of retention barbs 34 at top and bottom edge thereof for securing the shell 30 to the insulative housing 10.

The first plate 41 of the board lock 40 is coplanar with the front face 110 of the body portion 11 and contacts with the flat portion 31 of the metal shell 30. The first plates 41 of the board locks 40 are sandwiched by the metal shell 30 and the insulative housing 10 directly without additional fasteners which not only simplify the construction of the electrical connector 100 but also the facilitating the assembly of the electrical connector 100.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. An electrical connector comprising:

an insulative housing having a body portion and a mating portion projecting from the body portion, the body portion comprising a pair of receiving spaces extending therethrough;

a plurality of contacts retained in the insulative housing;

a pair of board locks each comprising a first plate, a hook section extending out of the insulative housing, and a connect section connecting the first plate with the hook section, the first plate including a hollow cylinder extending therefrom, the connect section of the board lock includes a second plate extending vertically from a side edge of the first plate and a third plate parallel to the first plate; and a metal shell secured to the insulative housing and defining a pair of trough holes corresponding to the hollow cylinders respectively, the metal shell and the insulative housing sandwiching the first plates of the board locks therebetween.

2. The electrical connector as claimed in claim 1, wherein the hook section is connected with the third plate and perpendicular to the first plate.

3. The electrical connector as claimed in claim 2, wherein the second and third plate include a rib thereon for abutting to the insulative housing.

4. The electrical connector as claimed in claim 1, wherein the mating portion is apart from the body portion and extending into in a central space of the body portion.

5. The electrical connector as claimed in claim 1, wherein the receiving spaces of the insulative housing each comprises a first recess and a second recess, and wherein the first plate is received in the first recess and the connect section and the hollow cylinder are received in the second recess.

6. The electrical connector as claimed in claim 5, wherein the metal shell comprises a plurality of retention barbs at top and bottom edge thereof for securing the shell to the insulative housing.

7. The electrical connector as claimed in claim 4, further comprising a full-proofing device arranged on one side of the insulative housing, and wherein the full-proofing device includes a post and a slit mating with each other and being arranged on the body portion and the mating portion, respectively.

8. An electrical connector comprising:

a body portion comprising a central space;

a mating portion apart from the body portion and attached to the central space of the body portion;

a plurality of contacts retained in the body portion and the mating portion; a metal shell shielding the body portion and the mating portion;

a pair of board locks received in the body portion and contact with the metal shell, each board lock comprising a hook section extending out of the body portion, and a connect section connecting the first plate with the hook section, the first plate including a hollow cylinder extending therefrom, the connect section of the board lock includes a second plate extending vertically from a side edge of the first plate and a third plate parallel to the first plate; and the metal shell and the insulative housing sandwiching the first plates of the board locks therebetween; and a full-proofing device including a post and a slit mating with each other, the post and the slit being arranged only on one side of the body portion and the mating portion respectively.

9. The electrical connector as claimed in claim 8, wherein the pair of board locks each includes a hollow cylinder and the metal shell defines a pair of through holes corresponding to the hollow cylinders.

10. The electrical connector as claimed in claim 8, wherein the body portion and the mating portion each defines a mating face to contact with each other.

11. The electrical connector as claimed in claim 10, wherein the post is projecting from the mating face of the body portion and the slit is defined on the mating face of the mating portion.

12. An electrical connector comprising:

an insulative housing having a body portion defining a pair of receiving spaces at two opposite longitudinal ends with therebetween a mating portion extending forwardly, each of said receiving spaces extending rearwardly along the housing in a front-to-back direction under essentially a fully surrounding manner;

a plurality of contacts disposed in the mating portion;

a pair of board locks disposed in the corresponding receiving spaces, respectively, each of said board locks including a hook section extending rearward out of a rear portion of the housing, a first plate essentially rearwardly abutting against a front face of the body portion, an internally threaded hollow cylinder portion unitarily extending rearward from the first plate, a connect section connecting the plate with hook section, the connect section of the board lock includes a second plate extending vertically from a side edge of the first plate and a third plate parallel to the first plate; and a metallic shell fastened to the housing and defining a flat portion cooperating with the front face of the body portion to tightly sandwich the plate therebetween in said front-to-back direction; wherein the flat portion of the shell defines an through hole to expose said internally threaded portion to an exterior for allow art external screw to extend therethrough; wherein said receiving space is dimensioned and configured to receive and allow passing of the locking head along the front-to-back direction during assembling the board lock to the housing;

wherein the metallic shell and the insulative housing sandwiching the first plates of the board locks therebetween.

13. The electrical connector as claimed in claim 12, wherein said receiving space defines a large front opening and small rear opening to receive the corresponding board lock therein.

14. The electrical connector ad claimed in claim 12, wherein the shell is fastened to the housing at positions around the pair of the board locks.

15. The electrical connector as claimed in claim 12, wherein said mating portion is discrete from the body portion.

16. The electrical connector as claimed in claim 15, wherein said shell commonly prevent both said mating portion and the board locks from being withdrawn from the body portion.

17. The electrical connector as claimed m claim 12, wherein said hook section is aligned within the corresponding receiving space in said front-to-back direction for allowing assembling said board lock into the receiving space along said front-to-back direction.

18. The electrical connector as claimed in claim 17, wherein said board lock further includes a connection section linked between the hook section and the plate, under a condition that the receiving space is dimensioned and configured to be large enough to receive said connection section therein.

19. The electrical connector as claimed in claim 18, wherein said connection section is of an L-shaped configuration so as to cooperate with the plate to commonly form a U-like configuration.

20. The electrical connector as claimed in claim 18, wherein the hook section is of a blade type, and said receiving space does not extend through a rear face of the housing but with a narrow slit to rearward communicate with said exterior for allowing the hook section to extend rearward therefrom.

* * * * *